US005343981A

United States Patent [19]

Schroemges et al.

[11] Patent Number: 5,343,981

[45] Date of Patent: Sep. 6, 1994

[54] EMERGENCY CABLE DESCENT SYSTEM

[76] Inventors: Cyril R. Schroemges; Gene F. Kull, Jr., both of American Embassy, PSC 74 Box 026, APO AE 09718, Rabat, Morocco

[21] Appl. No.: 125,767

[22] Filed: Sep. 24, 1993

[51] Int. Cl.[5] ..... A62B 1/00

[52] U.S. Cl. ..... 182/231; 182/236; 182/71; 182/18

[58] Field of Search ..... 182/70, 73, 236–240, 182/71, 72, 231–235, 18

[56] References Cited

U.S. PATENT DOCUMENTS 643,286 2/1900 Feiker ..... 182/236

872,050 11/1907 Burhans ..... 182/239

*Primary Examiner*—Alvin C. Chin-Shue

*Attorney, Agent, or Firm*—Gary Alan Culliss

[57] ABSTRACT

An emergency cable descent system for lowering a person from a building in an emergency situation. The system includes a boom which may be pivoted outside a window of a building to support a cable away from an exterior of the building. The cable is contained upon a spool which rotates against a force of a friction brake to provide a constant rate of descent. The friction brake is actuated by a solenoid system to control the rate of descent according to the body weight of the person. Alternate embodiments of the present invention include both a mechanical siren for alerting other occupants of the building to a use of the system and a mechanical brake assembly which may be utilized to control the rate of descent in an absence of electrical power.

5 Claims, 4 Drawing Sheets

EMERGENCY CABLE DESCENT SYSTEM

BACKGROUND OF THE INVENTION

1. Field of the Invention

The present invention relates to fire escapes and more particularly pertains to an emergency cable descent system for lowering a person from a building in an emergency situation.

2. Description of the Prior Art

The use of fire escapes is known in the prior art. More specifically, fire escapes heretofore devised and utilized for the purpose of assisting persons in escaping from a building are known to consist basically of familiar, expected and obvious structural configurations, notwithstanding the myriad of designs encompassed by the crowded prior art which have been developed for the fulfillment of countless objectives and requirements.

For example, a fire escape with a cable reel brake is illustrated in U.S. Pat. No. 4,602,699 which utilizes a housing containing a rotatable cable drum therein with a cable connected thereto and extending from the housing for connection with a supporting structure. The housing may be connected to a person descending from an upper floor of a building or the like during an emergency situation such as a fire. An automatic brake mechanism controls the rate of descent of such a person by applying a braking force to a rotatable component geared to the cable drum for controlling unreeling movement of the cable.

An emergency descending device is disclosed in U.S. Pat. No. 5,060,758 which comprises a rotary wheel and a cam mounted between a pair of side plates with a main rope passing between the rotary wheel and the cam. A rotation of the rotary wheel caused by the main rope generates a centrifugal force on a brake shoe, thereby causing a rotation of a brake drum. The rotation of the brake drum pivots the cam towards the rotary wheel, thereby clamping the main rope therebetween to provide a suitable descending speed.

Another patent of interest is U.S. Pat. No. 4,729,454 which describes a self braking safety apparatus for the rapid descent of persons in cases of emergency. The apparatus can be secured to a fixed point from which the descent is to be made and comprises a rotor on which a rope is wound mounted coaxially of a drum. A heat resistant handle and a brake which can be actuated by the user are secured to the drum by brackets. The brake may be utilized to stop the device and when the hand brake is released, the rotation of the rotor and the centrifugal force generated thereby exert a braking action against the inner surface of the drum to produce a constant descent speed of about 2.5 m/sec.

Other relevant documents include U.S. Pat. No. 4,949,812, and U.S. Pat. No. 4,485,893.

While these devices fulfill their respective, particular objectives and requirements, the aforementioned patents do not describe an emergency cable descent system for lowering a person from a building which includes a boom that may be pivoted outside a window of a building to support a cable away from the exterior of the building, whereby the person may be lowered from the building at a safe distance therefrom. Furthermore, none of the known prior art fire escapes teach or suggest a cooperating mechanical siren for alerting other occupants of the building to a use of the system.

In these respects, the emergency cable descent system according to the present invention substantially departs from the conventional concepts and designs of the prior art, and in so doing provides an apparatus primarily developed for the purpose of lowering a person from a building in an emergency situation.

SUMMARY OF THE INVENTION

In view of the foregoing disadvantages inherent in the known types of fire escapes now present in the prior art, the present invention provides a new emergency cable descent system construction wherein the same can be utilized for lowering a person from a building in an emergency situation. As such, the general purpose of the present invention, which will be described subsequently in greater detail, is to provide a new emergency cable descent system apparatus which has many of the advantages of the fire escapes mentioned heretofore and many novel features that result in a emergency cable descent system which is not anticipated, rendered obvious, suggested, or even implied by any of the prior art fire escapes, either alone or in any combination thereof.

To attain this, the present invention essentially comprises an emergency cable descent system for lower a person from a building in an emergency situation. The system includes a boom which may be pivoted outside a window of a building to support a cable away from an exterior of the building. The cable is contained upon a spool which rotates against a force of a friction brake to provide a constant rate of descent. The friction brake is actuated by a solenoid system to control the rate of descent according to the body weight of the person. Alternate embodiments of the present invention include both a mechanical siren for alerting other occupants of the building to a use of the system and a mechanical brake assembly which may be utilized to control the rate of descent in an absence of electrical power.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new emergency cable descent system apparatus which has many of the advantages of the fire escapes mentioned heretofore and many novel features that result in a emergency cable descent system which is not anticipated, rendered obvious, suggested, or even implied by any of the prior art fire escapes, either alone or in any combination thereof.

It is another object of the present invention to provide a new emergency cable descent system which may be easily and efficiently manufactured and marketed.

It is a further object of the present invention to provide a new emergency cable descent system which is of a durable and reliable construction.

An even further object of the present invention is to provide a new emergency cable descent system which is susceptible of a low cost of manufacture with regard to both materials and labor, and which accordingly is then susceptible of low prices of sale to the consuming public, thereby making such emergency cable descent systems economically available to the buying public.

Still yet another object of the present invention is to provide a new emergency cable descent system which provides in the apparatuses and methods of the prior art some of the advantages thereof, while simultaneously overcoming some of the disadvantages normally associated therewith.

Still another object of the present invention is to provide a new emergency cable descent system for lowering a person from a building in an emergency situation.

Yet another object of the present invention is to provide a new emergency cable descent system that includes a boom which may be pivoted outside a window of a building to support a cable away from an exterior of a building, whereby a person may be lowered by the cable from the building at a safe distance therefrom.

Even still another object of the present invention is to provide a new emergency cable descent system in which a cable is contained upon a spool that rotates against a force of a solenoid operated friction brake to provide a constant rate of descent according to the body weight of the person being lowered.

Even still yet another object of the present invention is to provide a new emergency cable descent system which includes both a mechanical siren for alerting other occupants of the building to a use of the system and a mechanical brake assembly which may be utilized to control the rate of descent in an absence of electrical power.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
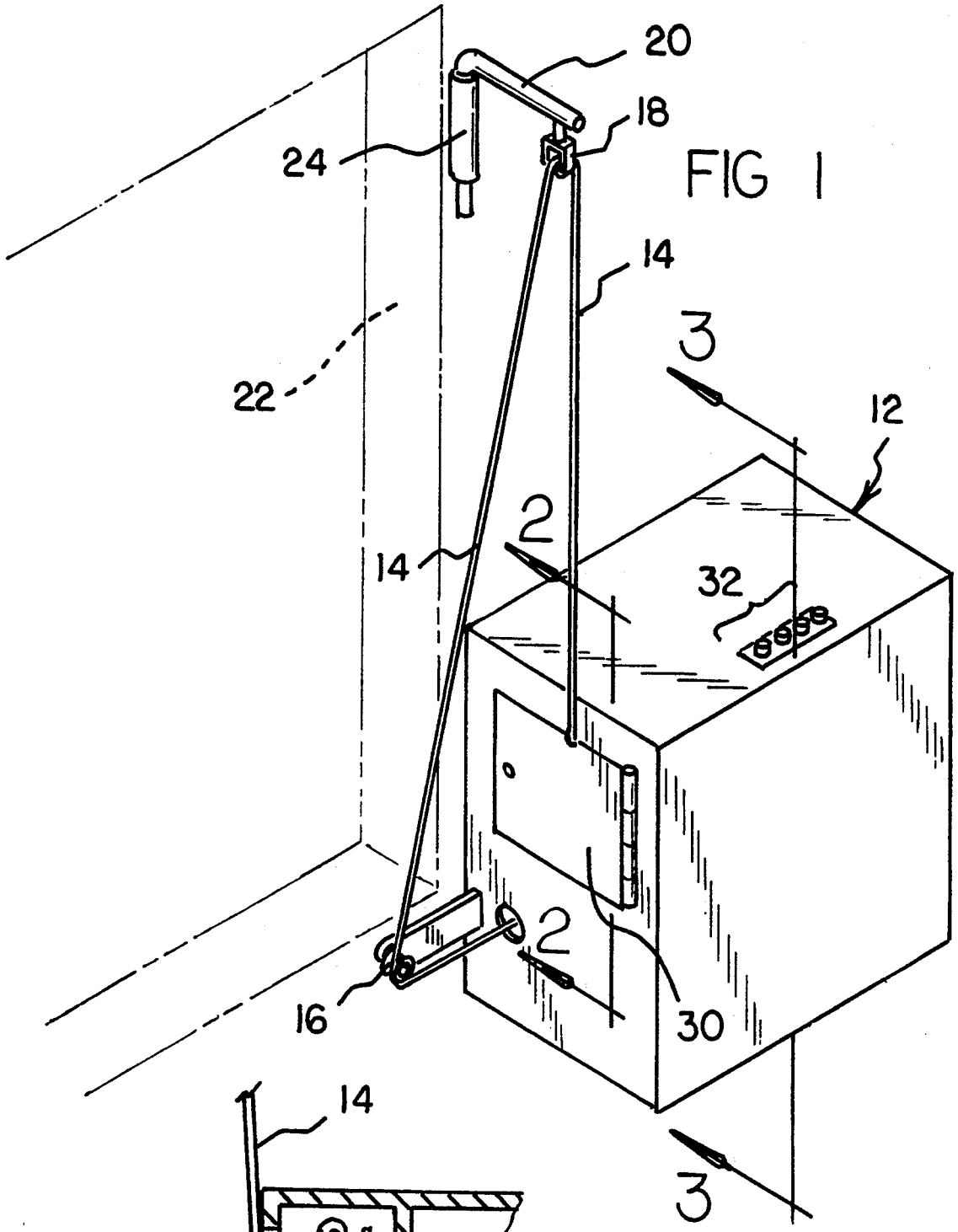
FIG. 1 is a perspective view of a first embodiment of an emergency cable descent system comprising the present invention.

With reference now to the drawings, and in particular to FIGS. 1–6 thereof, a first embodiment of a new emergency cable descent system embodying the principles and concepts of the present invention and generally designated by the reference numeral 10 will be described.

Figure 2:
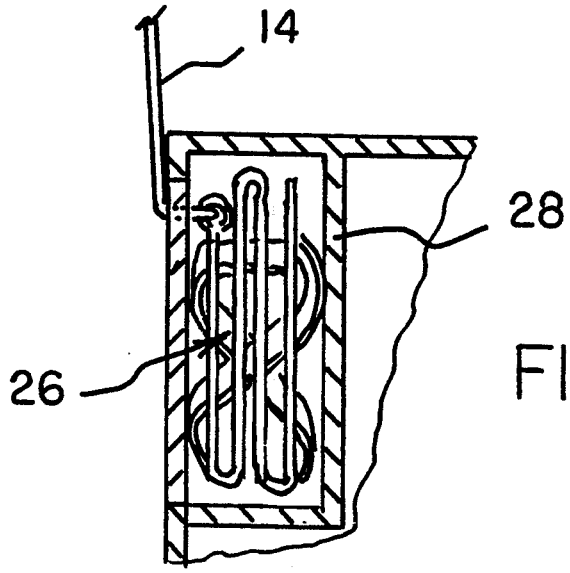
FIG. 2 is an enlarged cross section view of a portion of the present invention taken along line 2—2 of FIG. 1.
Figure 6:
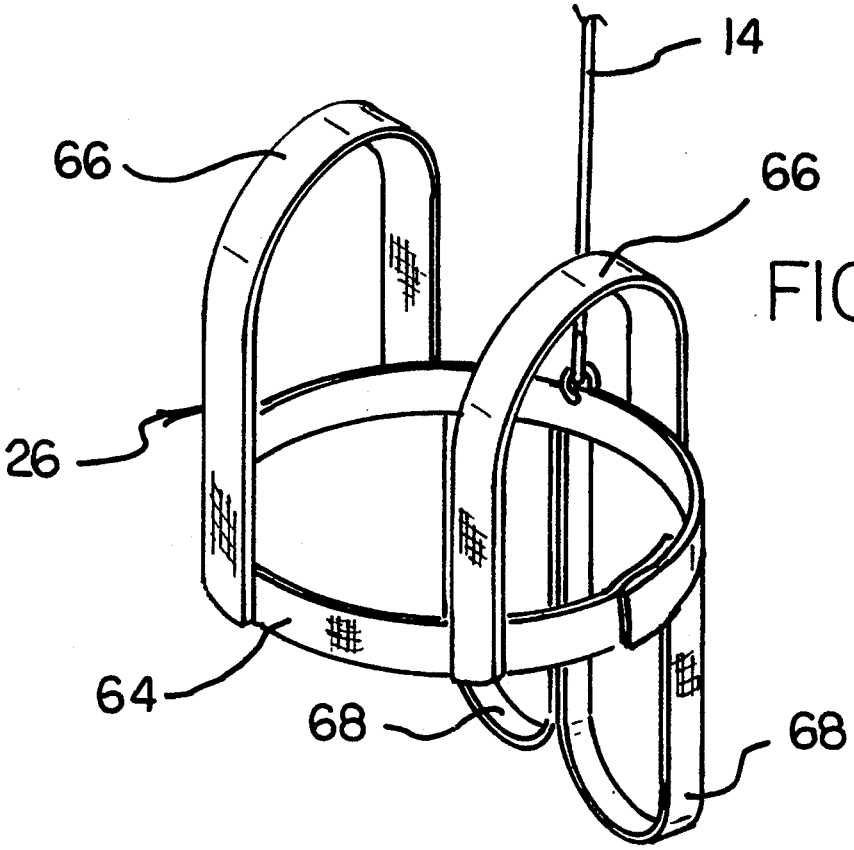
FIG. 6 is a perspective view of a harness comprising a portion of the present invention.

The emergency cable descent system 10 comprises a descent control assembly 12 from which a cable 14 is selectively dispensed. The cable 14 is supported by both a lower pulley 16 coupled to the descent control assembly 12 and an upper pulley 18 positioned at a distal end of a boom 20. The boom 20 is supported near a window 22 of a building by a boom pivot 24 such that the boom may be swung through the open window to support the cable 14 a safe distance from an exterior of the building. As best illustrated in FIG. 6, the cable 14 is coupled to a harness 26 which may be secured to a person to be lowered from the building. When not in use, the harness 26 is conveniently contained within a storage compartment 28 of the descent control assembly 12, as best illustrated in FIG. 2. Access to the storage compartment 28 is provided through a hinged storage compartment door 30 which facilitates rapid access to the harness 26 contained therein.

The descent control assembly 12 is operable to dispense the cable 14 in a manner which provides a constant rate of descent for the person escaping the building. The descent control assembly 12 has a plurality of weight selection buttons 32, one of which may be selected to approximately match the weight of the person being lowered, thereby actuating a brake assembly 34 which will subsequently be described in greater detail to provide a controlled descent rate.

In use, the emergency cable descent system 10 may be utilized by opening the storage compartment door 30 whereby the harness 26 may be removed from the storage compartment 28 and secured to the person to be lowered. Next, the approximate weight of the person is selected by depressing one of the weight selection buttons 32. The window 22 may then be opened such that the boom 20 can be pivoted out the window and the person may exit the building through the window and steadily descend to the ground therebelow at a constant rate. The emergency cable descent system 10 allows persons or objects to be lowered from a building during cases of emergency when conventional building exits are blocked or otherwise unavailable.

Figure 3:
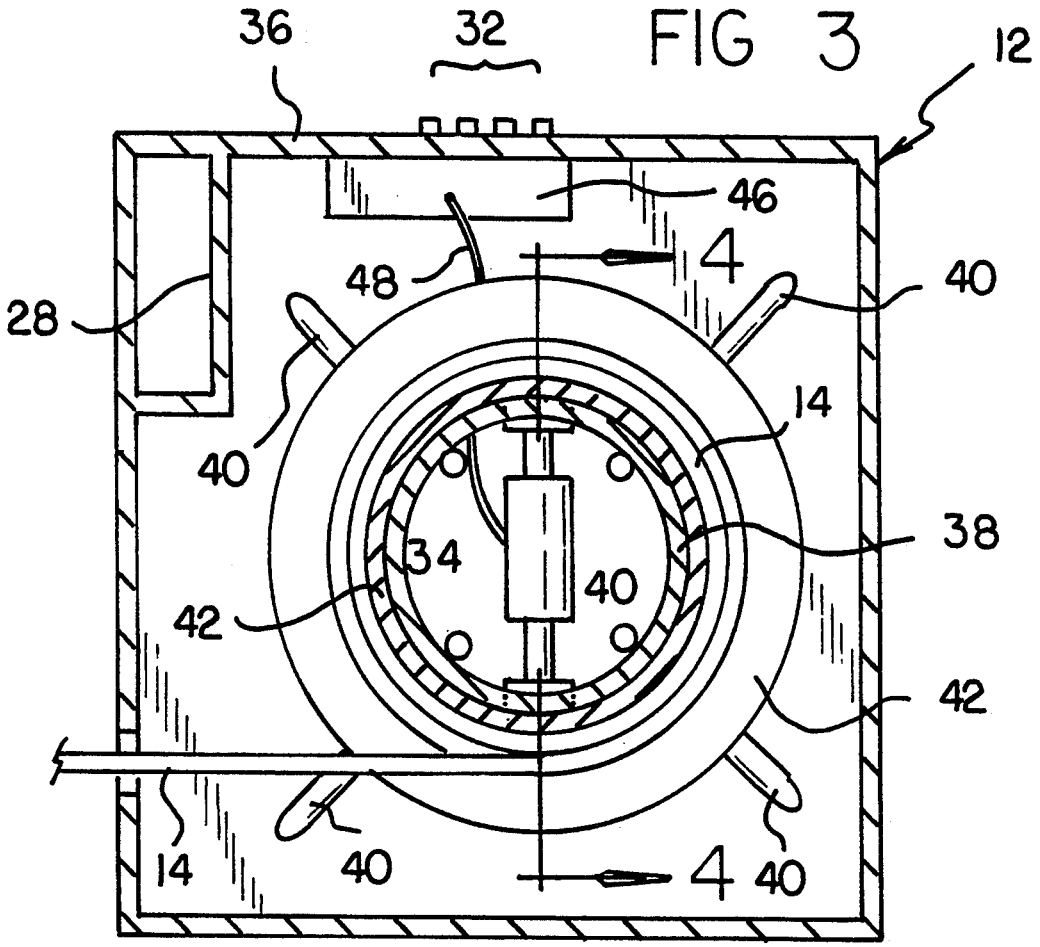
FIG. 3 is a cross section view taken along line 3—3 of FIG. 1.
Figure 4:
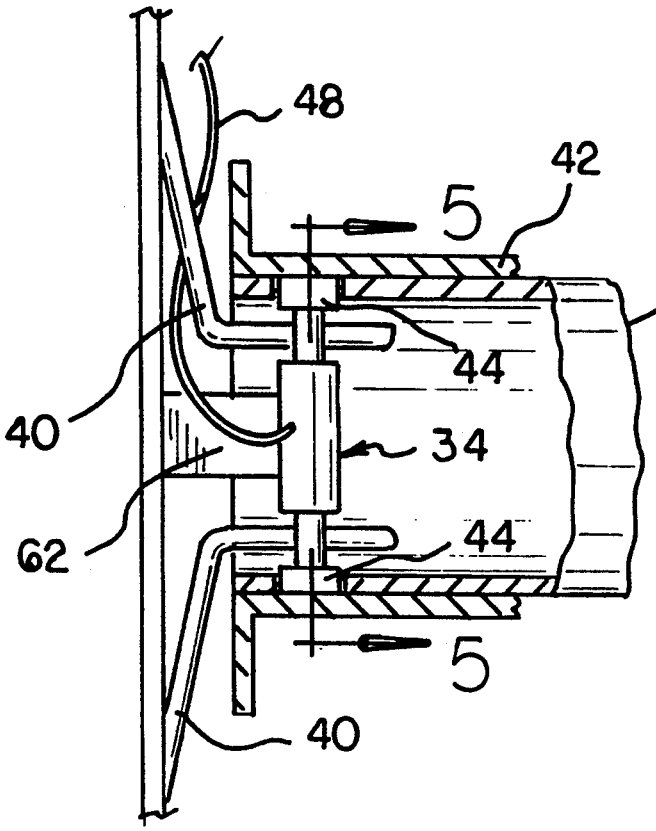
FIG. 4 is a further cross section view taken along line 4—4 of FIG. 3.

More specifically, it will be noted that the emergency cable descent system 10 comprises a descent control assembly 12 adapted to be fixedly secured to an interior of a building proximate a window 22. The descent control assembly 12 comprises a case 36 having a substantially rectangular cross section which supports and encloses a cylindrical axle 38 secured to the case by a plurality of axle support arms 40, as best illustrated in FIGS. 3 and 4. A spool 42 is rotatably supported by the cylindrical axle 38 and is free to rotate with respect thereto. The cable 14 is wound upon the spool 42 for storage and subsequent dispensing therefrom.

The cylindrical axle 38 includes a pair of unlabeled through-extending apertures which allow brake pads 44 to contact an interior surface of the spool 42. The brake pads 44 are operatively supported by a solenoid-operated brake assembly 34 which may be selectively energized by a brake controller 46 through wires 48 connected thereto. The brake controller 46 includes a plurality of weight selection buttons 32 which allow the brake assembly 34 to be selectively energized, thereby adjusting a pressure between the brake pads 44 and the interior surface of the spool 42 by a regulation of the current supplied to the solenoid-operated brake assembly. The brake control 46 may be coupled to the building's electrical system by an unillustrated power cord or other conventional wiring.

The brake controller 46 regulates a supply of current to the brake assembly 34 according to the predetermined physical characteristics of friction between the brake pads 44 and the interior of the spool 42 such that persons or objects being lowered by the emergency cable descent system 10 will be lowered at a constant rate. In the preferred embodiment, the weight selection buttons 32 are labeled 20, 80, 140, and 200 pounds. Accordingly, persons or objects weighing less than twenty pounds would select the twenty pound weight selection button, persons or objects weighing between 20 and 80 pounds would select the 80 pound button, persons or objects weighing between 80 and 140 pounds would select the 140 pound button, and persons or objects weighing between 140 and 200 pounds would select the 200 pound button. However, the weight selection buttons 32 may be calibrated and labeled to any value deemed appropriate, thereby allowing the emergency cable descent system 10 to lower objects or persons of any conceivable weight.

Figure 5:
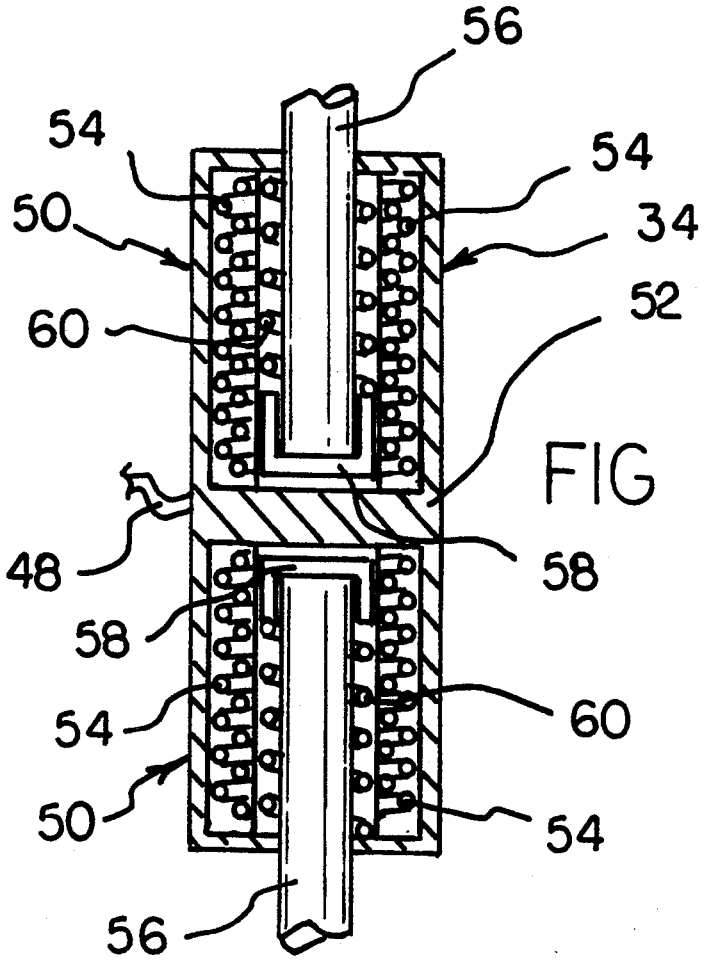
FIG. 5 is an even further cross section view of a portion of the invention taken along line 5—5 of FIG. 4.

FIG. 5 details an interior of the brake assembly 34 and it can be seen from this Figure that the brake assembly comprises a pair of opposed solenoids 50 which share respectively opposed ends of a solenoid cylinder 52. The solenoids 50 are substantially identical in design and function and, therefore, both of the solenoids will be described together. To define the solenoids 50, the opposed solenoid cylinder 52 is substantially cylindrically shaped and supports a pair of coils 54 on respectively opposed interior surfaces thereof, one coil being utilized for each solenoid 50. The coils 54 are electrically coupled to the brake controller 46 through the wires 48 as described above. Each solenoid 50 includes a rod 56 having a magnet 58 at an end thereof which passes through a center the coil 54 and is urged towards a center of the solenoid cylinder 52 by a return spring 60. Each of the rods 56 supports one of the brake pads 44, as best illustrated in FIG. 4, such that an energization of the solenoids 50 will bias the pads against the interior of the spool 42, thereby creating resistance to a rotational motion of the spool with respect to the cylindrical axle 38. The brake assembly 34 is fixedly secured to the case 36 by a brake assembly support 62 which couples the solenoid cylinder 52 to the case. Although the preferred embodiment uses a pair of opposed solenoids 50 to define the brake assembly 34, any number of solenoids may be utilized to provide the aforedescribed braking action.

FIG. 6 illustrates a construction of the harness 26 which effectively supports a person at an end of the cable 14 and it can be seen from this Figure that the harness comprises a waist strap 64 operable to encircle a user's waist. Fastened to the waist strap 64 is a pair of shoulder straps 66 and a pair of leg straps 68 operable to cooperatively support the person proximate to all four limbs. The cable 14 is connected to the waist strap 64 at a center front area thereof. The leg straps 68 support a person's thighs immediately below the buttocks, thereby allowing the person's legs to remain free and unobstructed for landing.

In use, the emergency cable descent system 10 may be utilized by opening the storage compartment door 30 whereby the harness 26 may be removed from the storage compartment 28 and secured to the person to be lowered. Next, the approximate weight of the person is selected by depressing one of the weight selection buttons 32. The window 22 may then be opened such that the boom 20 can be pivoted out the window and the person may exit the building through the window and steadily descend to the ground therebelow at a constant rate. The emergency cable descent system 10 allows persons or objects to be lowered from a building during cases of emergency when conventional building exits are blocked or otherwise unavailable.

Figure 7:
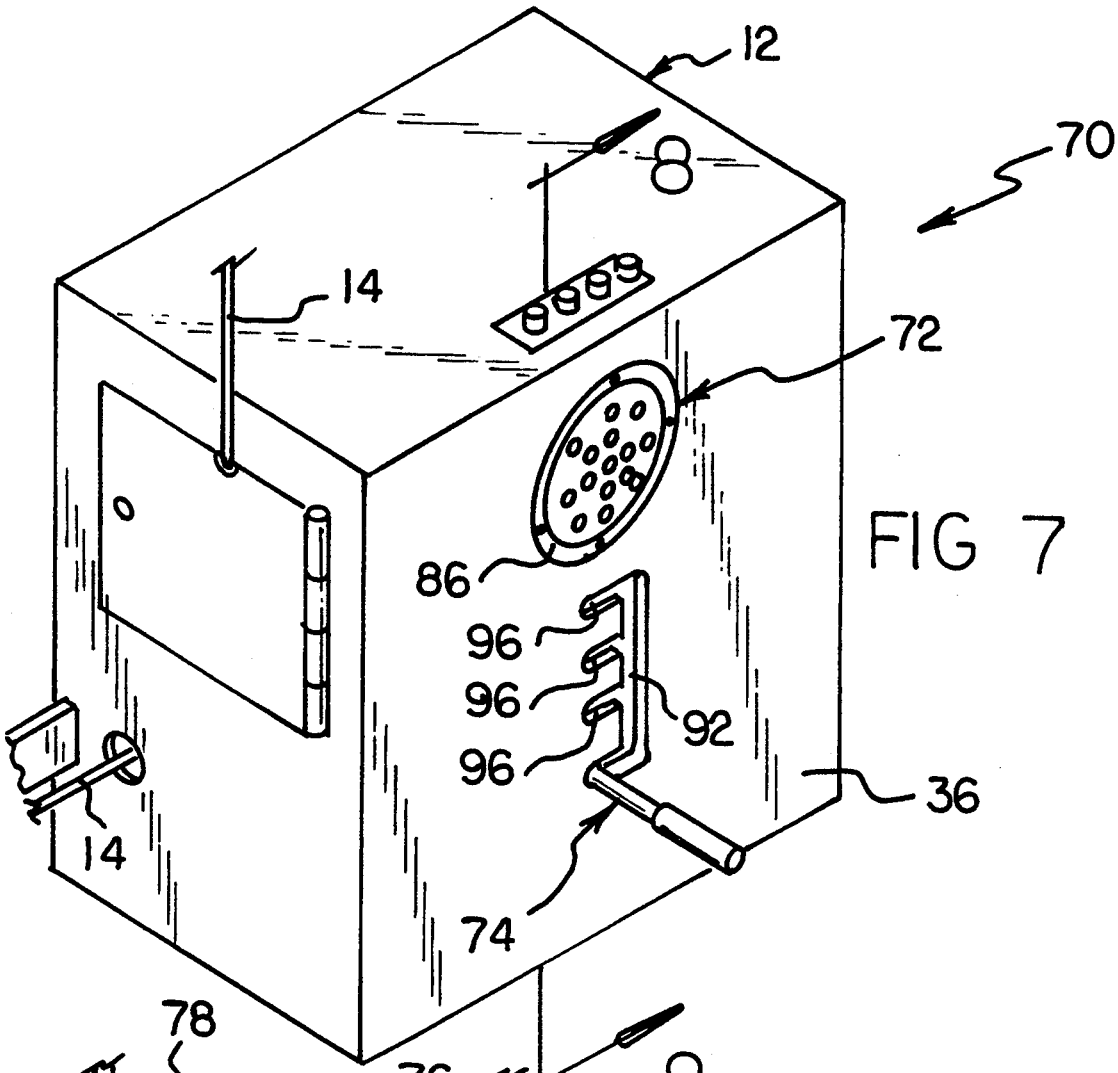
FIG. 7 is a perspective view of a second embodiment of an emergency cable descent system comprising the present invention.
Figure 8:
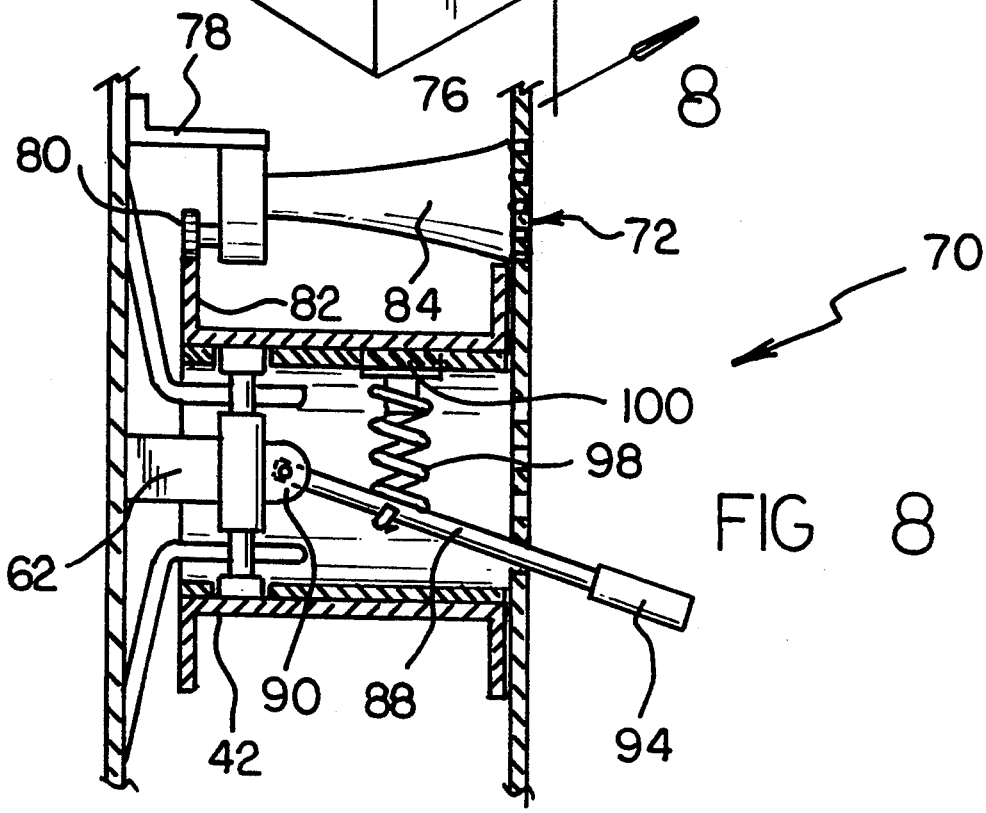
FIG. 8 is a cross section view of the second embodiment taken along line 8—8 of FIG. 7.

A second embodiment of the present invention as generally designated by the reference numeral 70, which comprises substantially all of the features of the foregoing embodiment 10 and which further comprises a siren assembly 72 and a manual brake assembly 74 will now be described. As best illustrated in FIGS. 7–8, it can be shown that the siren assembly 72 comprises a mechanical siren 76 positioned within an interior of the case 36 and supported by a bracket 78. The mechanical siren 76 is equipped with a siren gear 80 that engages an edge 82 of the spool 42. Both the siren gear 80 and the edge 82 of the spool 42 are provided with cooperating gear teeth which cause the siren gear to rotate as the cable 14 is dispensed from the descent control assembly 12 during a use of the emergency cable descent system 10. The siren 76 is provided with an elongated horn 84 which substantially amplifies a noise created by the mechanical siren. Such noise is allowed to escape from siren 76 exterior the case 36 through a grill 86 positioned thereover. The siren assembly 72 is operable to alert other occupants of the building to a use of the descent system 10, as well as emergency crews or other people outside of the building.

The second embodiment 70 also includes the manual brake assembly 74 which may be utilized in case of a power failure resulting in an absence of electrical power to the brake controller 46. As best illustrated in FIG. 8, the manual brake assembly 74 comprises a lever 88 supported by a lever pivot 90 coupled to the brake assembly support 62. The lever 88 projects through a lever guide 92 formed in the case 36 of the descent control assembly 12 where it is equipped with a handle 94 which may be used to position the lever within a plurality of slots 96 defined by the lever guide. A coil spring 98 is coupled to the lever 88 and supports a manual brake pad 100 against an interior of the spool 42 through a further unlabelled aperture in the cylindrical axle 38. The lever 88 may be positioned in any one of the slots 96 to provide increased friction between the manual brake pad 100 and the interior of the spool 42 in accordance with the weight of the person or objects being lowered by the emergency cable descent system 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new emergency cable descent system for lowering a person from a building having a window, said system comprising:

a cylindrical axle secured to said building;

a spool having an interior surface rotatably, concentrically positioned on said cylindrical axle;

a cable having a pair of ends and being partially wound upon said spool;

a boom pivotally mounted to said building proximate said window;

a pulley coupled to said boom, said cable passing over said pulley;

a harness coupled to one of said pair of ends of said cable; and, brake means coupled to said building for controlling a rotational speed of said spool with respect to said cylindrical axle, wherein said brake means comprises a solenoid in electrical communication with a power source and positioned within said cylindrical axle, and a brake pad coupled to said solenoid, with said cylindrical axle having an aperture formed therein, whereby said solenoid is operable to bias said brake pad through said aperture in said cylindrical axle and into engagement with said interior surface of said spool.

2. The new emergency cable descent system of claim 1, wherein said brake means further comprises a brake controller means in electrical communication with said solenoid for electrically adjusting a force exerted by said brake pad against said interior surface of said spool.

3. The new emergency cable descent system of claim 2, and further comprising a case enclosing said spool and having a storage compartment for releasably containing said harness.

4. The new emergency cable descent system of claim 3, and further comprising a mechanical siren means supported by said case and mechanically coupled to said spool for generating a noise upon a rotation of said spool.

5. The new emergency cable descent system of claim 4, and further comprising a manual brake means coupled to said case and engagable to said interior surface of said spool for further controlling a rotational speed of said spool with respect to said cylindrical axle.

* * * * *